US007010874B2

(12) United States Patent
Uchijima et al.

(10) Patent No.: US 7,010,874 B2
(45) Date of Patent: Mar. 14, 2006

(54) MOUNTING FRAME UNIT FOR ATTACHING WORKING IMPLEMENTS TO A TRACTOR BODY

(75) Inventors: Akiyoshi Uchijima, Sakai (JP); Naoya Muramoto, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 10/800,396

(22) Filed: Mar. 12, 2004

(65) Prior Publication Data

US 2004/0265109 A1 Dec. 30, 2004

(30) Foreign Application Priority Data

Jun. 23, 2003 (JP) ..... 2003-178400
Jun. 23, 2003 (JP) ..... 2003-178401

(51) Int. Cl.
*B62D 21/18* (2006.01)
*B62D 49/00* (2006.01)

(52) U.S. Cl. ..... 37/417; 37/466; 296/204; 296/205; 280/781; 280/800; 172/272; 172/776

(58) Field of Classification Search ..... 414/686, 414/694, 680; 296/204, 205; 280/781–800; 172/272–275, 776; 37/417, 466
See application file for complete search history.

(56) References Cited

U.S. PATENT DOCUMENTS 6,056,502 A 5/2000 Takemura et al.
6,446,367 B1 9/2002 Muramoto et al.

FOREIGN PATENT DOCUMENTS

JP 10-007014 1/1998
JP 2000-272552 10/2000

*Primary Examiner*—Christopher J. Novosad
(74) *Attorney, Agent, or Firm*—The Webb Law Firm

(57) ABSTRACT

A mounting frame unit attached to a tractor body for enabling working implements such as a front loader and a backhoe to be attached to the tractor body. The mounting frame unit includes a pair of right and left main frames extending longitudinally of the tractor body, and connecting frames for connecting the main frames as spaced from each other. A lower mounting unit is disposed in a rearward section of each of the main frames for connection to a rear axle case forming part of the tractor body. An upper mounting unit for connection to the rear axle case is disposed on a bridge member that bridges upper positions of an upwardly opening cutout formed in the rearward section.

11 Claims, 16 Drawing Sheets

MOUNTING FRAME UNIT FOR ATTACHING WORKING IMPLEMENTS TO A TRACTOR BODY

BACKGROUND OF THE INVENTION

1. Field of the Invention

This invention relates to a mounting frame assembled to a tractor body for attaching working implements such as a front loader and a backhoe to the tractor body.

2. Description of the Related Art

A working vehicle called a TLB having a front loader attached to the front of a tractor and a backhoe attached to the rear of the tractor is known from Japanese Unexamined Patent Publication H10-7014 (FIG. 6), for example. The TLB has a mounting frame assembled to the tractor, and the front loader and backhoe are attached to this mounting frame. Front portions of the mounting frame are rigidly bolted to front axle frames, while rear portions of the mounting frame are attached to rear axle cases. Each of the rear portions of the mounting frame defines an upwardly opening cutout, and a sideways intermediate position of each rear axle case is fitted in the cutout. The mounting frame has a lower mounting unit fixed thereto and located below the rear axle case, and an upper mounting unit located above the rear axle case after the rear axle case is fitted in the cutout. By connecting the upper mounting unit and lower mounting unit with bolts and nuts, the upper mounting unit and lower mounting unit hold the rear axle case therebetween, whereby the rear portion of the mounting frame is mounted on the rear axle case. Furthermore, the mounting frame includes a bridge member for connecting a front position and a rear position of a cutout-forming region of each main frame after the rear portion of the mounting frame is mounted on the rear axle case. Such a conventional TLB has a drawback of requiring many components for the rear portions of the mounting frame to be mounted on the rear axle cases.

In a TLB having a mounting frame as disclosed in Japanese Unexamined Patent Publication 2000-272552, booms of a front loader and side frames to which boom cylinders for swinging the booms are connected are fixed to support decks forming part of the mounting frame. The side frames are connected by braces to front axle frames projecting forward from an engine. This construction is said to give difficulty to the user in attaching and detaching the front loader. It has been impossible to detach the front loader and attach a different working implement, or engage in an operation after detaching the front loader.

SUMMARY OF THE INVENTION

Having regard to the disadvantage of the prior art noted above, the object of this invention is to provide a mounting frame unit of simple construction for attachment to rear axle cases of a tractor. The mounting frame unit is also required to facilitate attachment and detachment of a front loader.

The above object is fulfilled, according to this invention, by a mounting frame unit attached to a tractor body for enabling working implements such as a front loader and a backhoe to be attached to the tractor body, comprising a pair of right and left main frames extending longitudinally of the tractor body, connecting frames for connecting the main frames as spaced from each other, a lower mounting unit disposed in a rearward section of each of the main frames and connected to a rear axle case forming part of the tractor body, a bridge member for bridging upper positions of an upwardly opening cutout formed in the rearward section, and an upper mounting unit disposed on the bridge member and connected to the rear axle case.

With this construction, each main frame has a cutout for directly receiving a rear axle case, and each bridge member is integrated with an upper mounting unit. Thus, the mounting frame unit is significantly simplified.

Preferably, each of the main frames is formed of a plate, and disposed to have a plate width extending vertically, each of the main frames having a vertical width progressively enlarging from front to rear. Then, despite the simple construction, the mounting frame unit has sufficient strength to withstand torsional loads.

In a preferred embodiment, the upper mounting unit defines an inclined contact surface for contacting an upper inclined contact surface formed on the rear axle case, and the lower mounting unit defines an inclined contact surface for contacting a lower inclined contact surface formed on the rear axle case. With this construction, a load applied from a working implement through the main frames to rear axle case attaching positions is distributed longitudinally or vertically of the tractor body.

Further, according to this invention, the mounting frame unit may include a loader mounting unit for detachably attaching side frames of a braceless type front loader. This construction facilitates attachment and detachment of the front load to/from the tractor body.

Other features and advantages of this invention will be apparent from the following description of the embodiment to be taken with reference to the drawings.

DESCRIPTION OF THE PREFERRED EMBODIMENT

Figure 1:
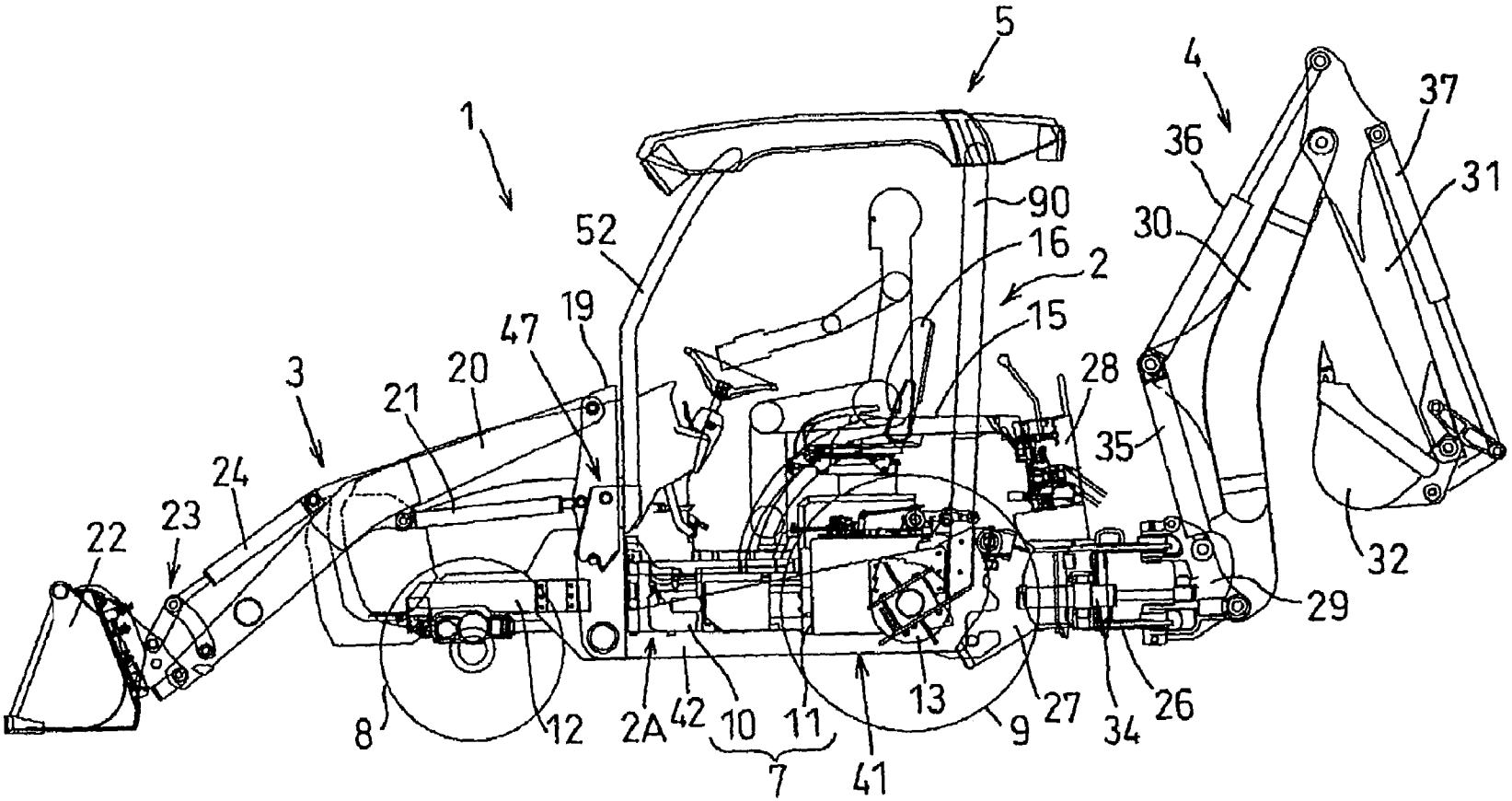
FIG. 1 is a side elevation of a TLB with a mounting frame unit according to this invention.
Figure 2:
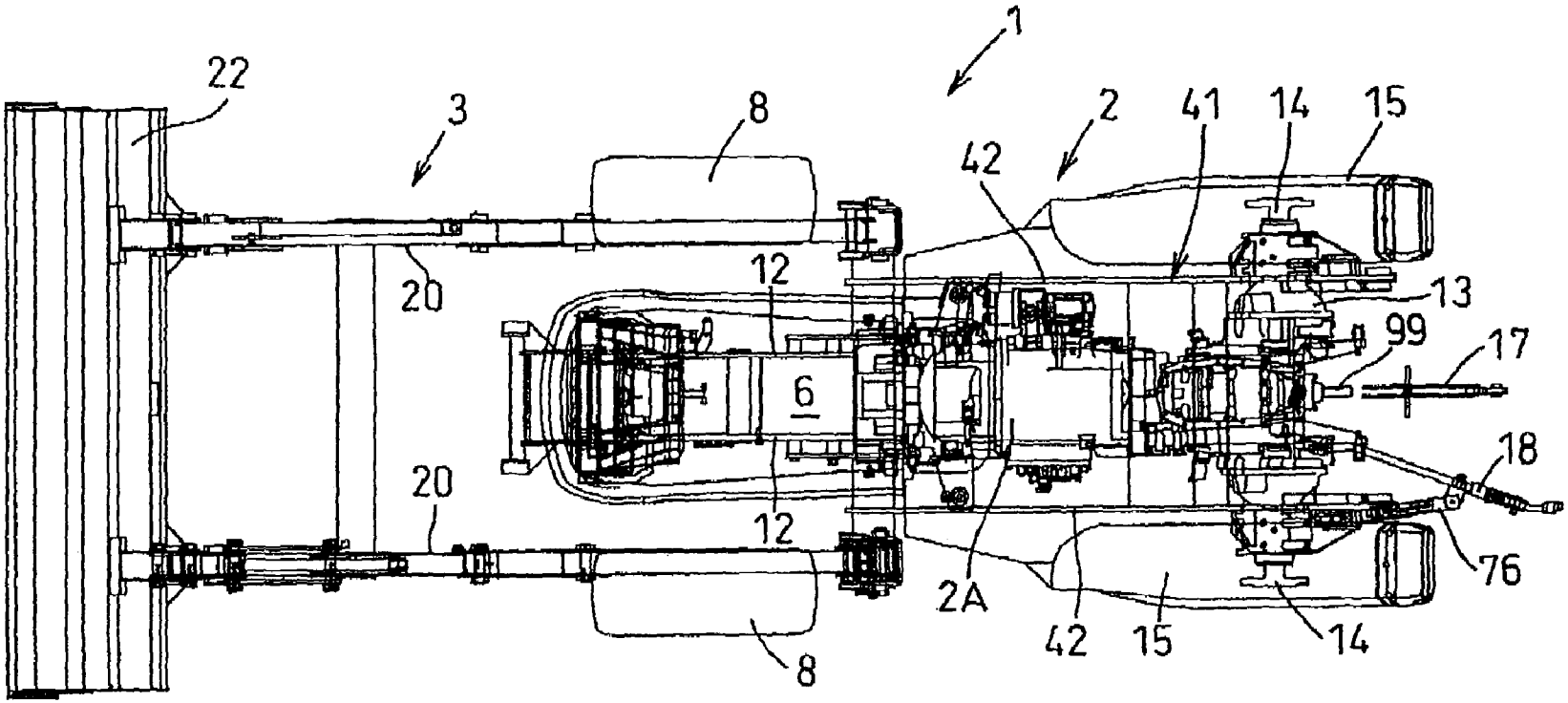
FIG. 2 is a plan view of a tractor and a front loader.
Figure 3:
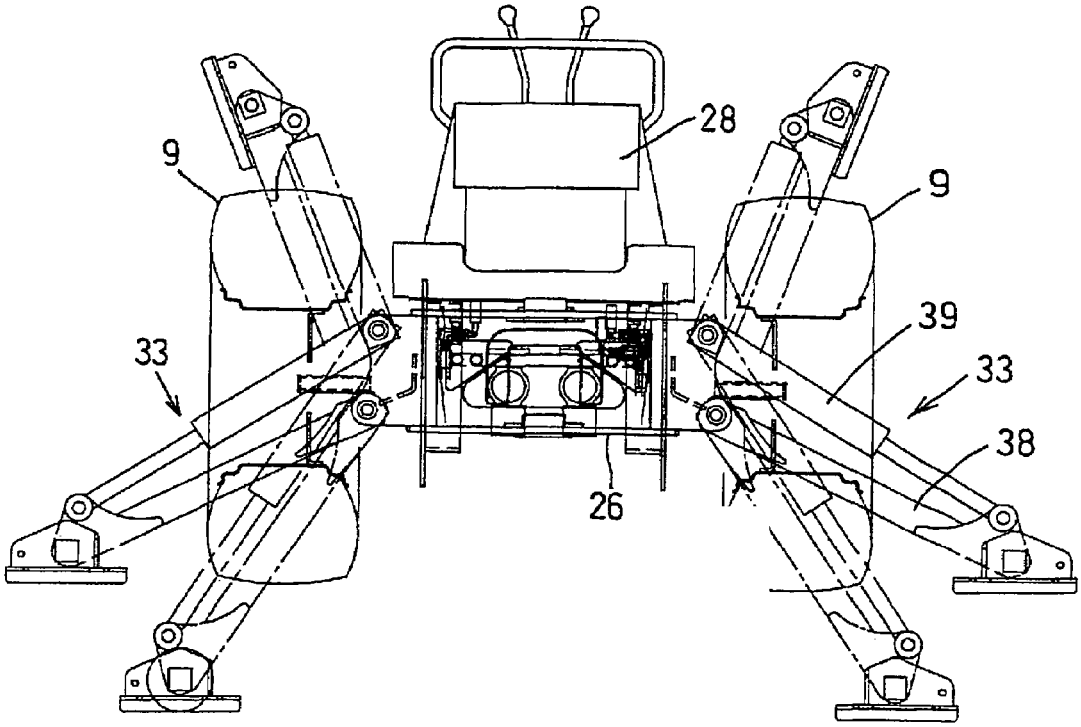
FIG. 3 is a rear view of the TLB.

In FIGS. 1 through 3, numeral 1 denotes a working vehicle called a TLB including a tractor 2 with a front loader 3 detachably attached to the front thereof, and a backhoe 4 detachably attached to the rear of the tractor 2.

The front loader 3 has a braceless structure.

The TLB 1 includes a FOPS/ROPS 5 with a four-post type ROPS having a FOPS function.

The tractor 2 includes a three-point link mechanism having a top link 17 and a pair of right and left lower links 18 attached to the rear of a tractor body 2A. Through this three-point link mechanism, a working implement such as a rotary plow may be attached to the rear of the tractor 2.

The three-point link mechanism is vertically movable, with the right and left lower links 18 swung up and down by lift arms of a hydraulic device mounted in a rear position of the tractor 2.

The body 2A of the tractor 2 has an engine 6 mounted on a forward portion thereof, and a transmission case 7 directly coupled to the rear of the engine 6. The body 2A is movably supported by a pair of right and left front wheels 8 and a pair of right and left rear wheels 9. The transmission case 7 includes a clutch housing 10 connected to the rear of the engine 6 through a flywheel housing, and a gearbox 11 formed integral with or separately from and connected to the rear of the clutch housing 10.

Front axle frames 12 are fixed to lower positions on right and left side surfaces of the engine 6 by a plurality of bolts or the like. The front axle frames 12 extend forwardly from the side surfaces of the engine 6.

The rear portion of tractor body 2A includes rear axle cases 13 fixed to and projecting laterally outward from right and left sides of the gearbox 11.

The rear axle cases 13 have rear axles 14 supported therein to be rotatable about a transverse axis by power transmitted from the engine 6. The rear wheels 9 are attached to the rear axles 14.

Fenders 15 are arranged inwardly of the right and left rear wheels 9 for covering the rear wheels 9. A driver's seat 16 is disposed between the right and left fenders 15.

The driver's seat 16 is supported on a floor sheet mounted on the gearbox 11 to be rotatable about a vertical axis. The driver's seat 16 is switchable between a forward facing position for controlling the tractor 2 and front loader 3, and a backward facing position for controlling the backhoe 4.

Figure 4:
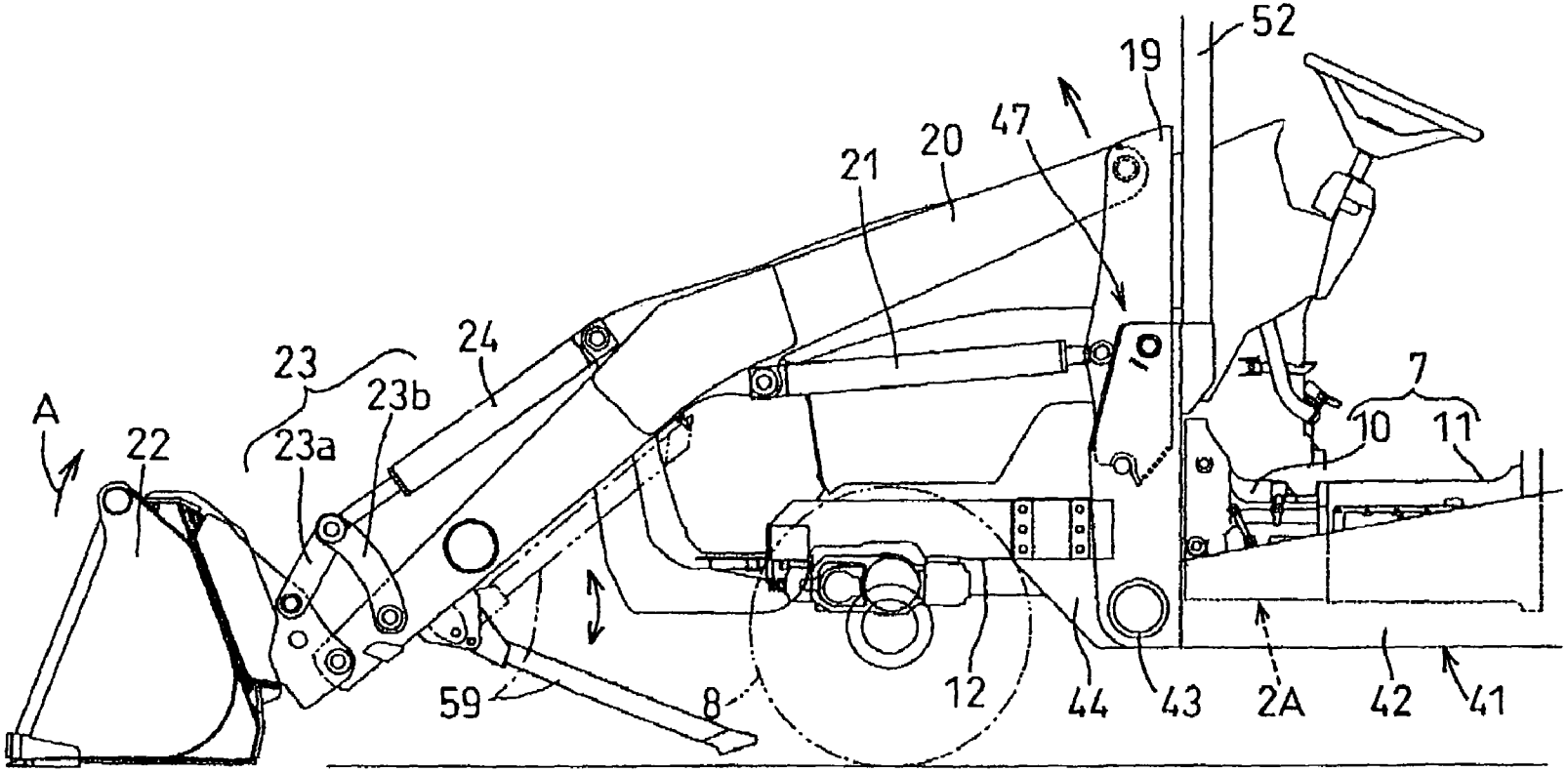
FIG. 4 is a side view of a front portion of the TLB.

As shown in FIG. 4 also, the front loader 3 includes, arranged forwardly of the tractor 2, right and left pairs of side frames 19, booms 20 attached to upper positions of the side frames 19 to be pivotable about a transverse axis, and boom cylinders 21 extending between the booms 20 and side frames 19. A bucket 22 is pivotally connected to front ends of the right and left booms 20 to be pivotable about a transverse axis. A bucket cylinder 24 extends between the booms 20 and bucket 22.

Each boom cylinder 21 is connected at one end thereof to a vertically intermediate position on a front part of the side frame 19 to be pivotable about a transverse axis, and at the other end to a longitudinally intermediate position on the undersurface of the boom 20 to be pivotable about a transverse axis. The boom 20 is swung up and down by extending and contracting the boom cylinder 21.

A link mechanism 23 is provided between forward ends of the booms 20 and bucket 22. The link mechanism 23 includes a first link 23*a* pivotally connected to the bucket 22, and a second link 23*b* pivotally connected at one end thereof to the first link 23*a* and at the other end pivotally connected to the forward ends of the booms 20.

The bucket cylinder 24 is connected at one end thereof to longitudinally intermediate positions on the upper surfaces of the booms 20 to be pivotable about a transverse axis, and at the other end to the pivotal connection between the first link 23*a* and second link 23*b* of the link mechanism 23. The bucket 22 is operable to take scooping and dumping action by extending and contracting the bucket cylinder 24.

The backhoe 4 includes a base 26, a pair of right and left mounts 27 fixed to the front of the base 26, a control device 28 mounted on the base 26, a swing bracket 29 supported through a cross pin at the rear of the base 26 to be swingable right and left about a vertical axis, a boom 30 supported by the swing bracket 29 to be pivotable about a transverse axis, an arm 31 supported by a distal end of the boom 30 to be pivotable about a transverse axis, a bucket 32 connected to a distal end of the arm 31 for scooping and dumping operations, and outriggers 33 arranged at right and left sides of the base 26.

The base 26 includes a swing cylinder 34 for swinging the swing bracket 29 right and left. A boom cylinder 35 extends between the swing bracket 29 and boom 30 for vertically swinging of the boom 30. An arm cylinder 36 extends between the boom 30 and arm 31 for swinging the arm 31. A bucket cylinder 37 extends between the arm 31 and bucket 32 for operating the bucket 32.

Each of the right and left outriggers 33 is supported at one end thereof by the base 26 to be pivotable about a longitudinal axis. Each outrigger 33 includes, as main components thereof, a leg 38 disposed at the other end thereof and having a ground-engaging plate, and a hydraulic cylinder 39 extending between the leg 38 and base 26 for vertically swinging the 38.

The tractor body 2A includes a mounting frame 41. The mounting frame 41 has forward portions thereof fixed to the front axle frames 12, and rearward portions fixed to the rear axle cases 13. The front loader 3 is attached to the front of the mounting frame 41, while the backhoe 4 is attached to the rear of the mounting frame 41.

Figure 5:
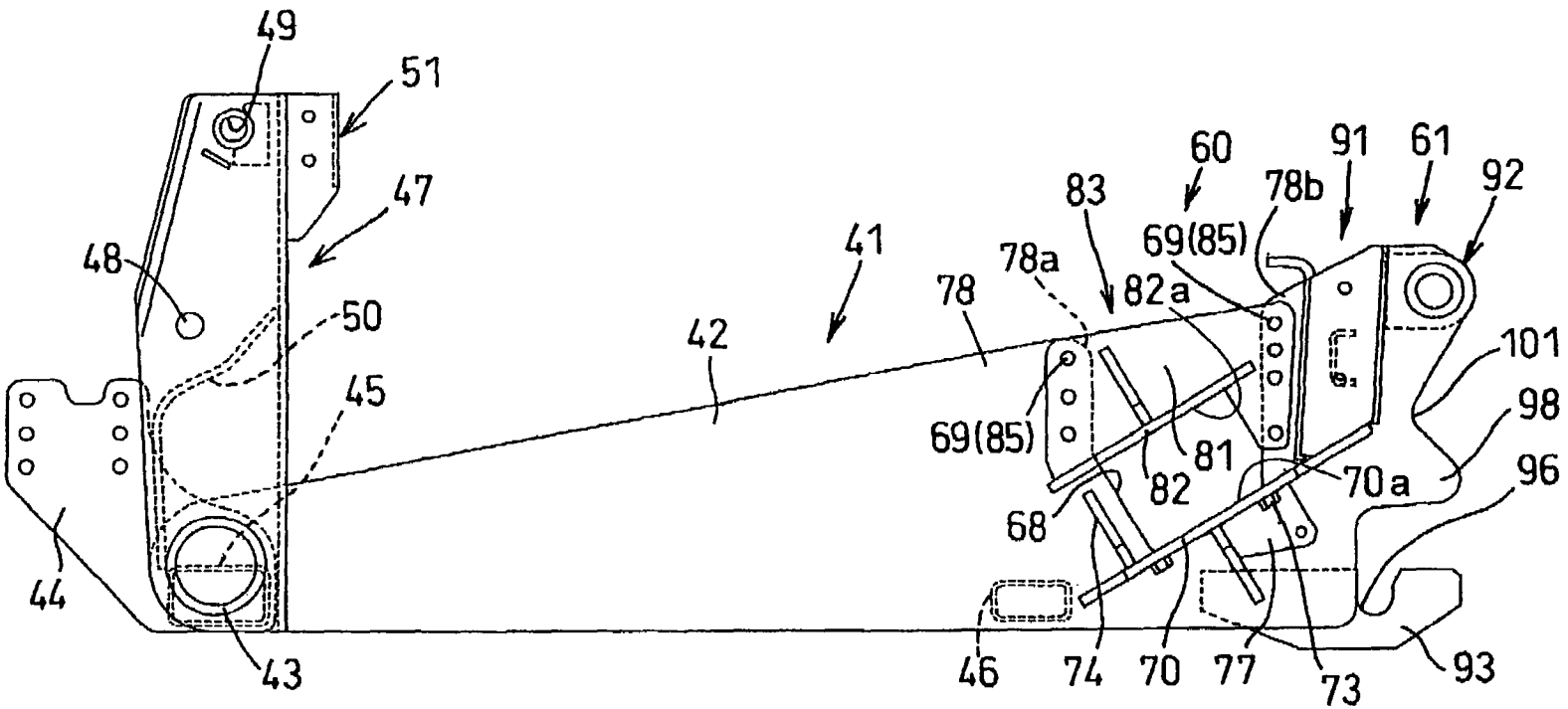
FIG. 5 is a side view of a mounting frame.
Figure 6:
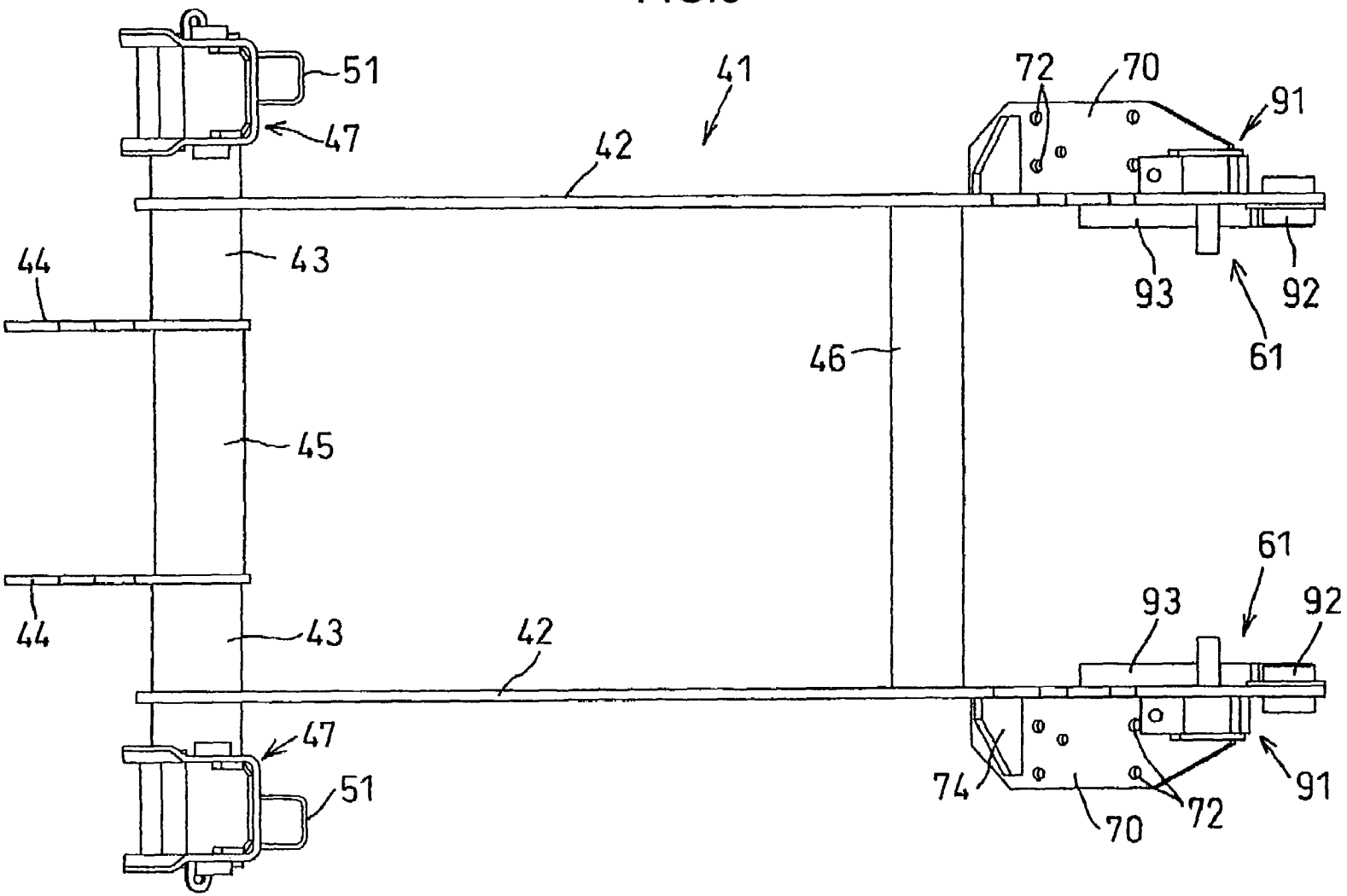
FIG. 6 is a plan view of the mounting frame.
Figure 7:
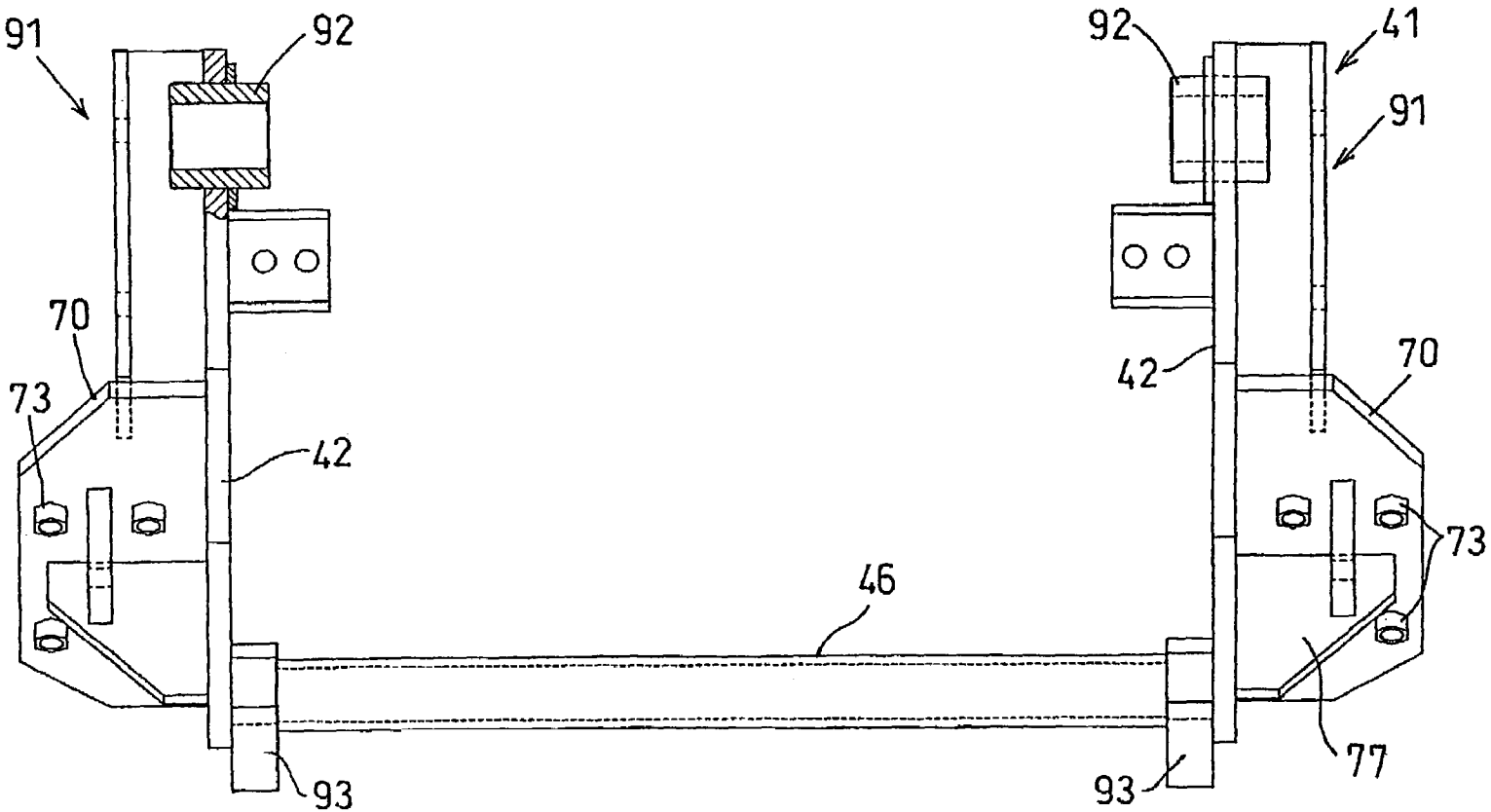
FIG. 7 is a rear view of the mounting frame.

As shown in FIGS. 5 through 7, the mounting frame 41 includes a pair of right and left main frames 42 extending along right and left sides of the body 2A of the tractor 2 from the sides of the rear of the engine 6 to the sides of the gearbox 11.

Each of the right and left main frames 42 is formed of one plate, with a vertical width progressively enlarging as it extends rearward.

A front portion of each of the right and left main frames 42 is transversely penetrated by and fixed such as by welding to a support base 43 in the form of a cylinder having an axis extending in the transverse direction. A mounting bracket (front mount) 44 is fixed such as by welding to and projecting forward and upward from a transversely inward end of each of the right and left support bases 43.

Between these right and left mounting brackets 44 is a front connecting member 45 formed of square pipe or the like and extending transversely below the engine 6. The front connecting member 45 connects the right and left mounting brackets 44.

The front portions of the right and left main frames 42 are connected to each other by these support bases 43, mounting brackets 44 and front connecting member 45.

Front portions of the mounting brackets 44 are arranged on outer right and left surfaces of the front axle frames 12, and fixed to the front axle frames 12 by bolts or the like.

Rear portions of the right and left main frames 42 are connected to each other by a rear connecting member 46 formed of square pipe or the like and extending transversely below the gearbox 11 and in front of the rear axle cases 13.

A pair of right and left loader mounts (working implement mounts) 47 are arranged in front portions of the mounting frame 41 for detachably attaching the side frames 19 of the front loader 3.

Figure 8:
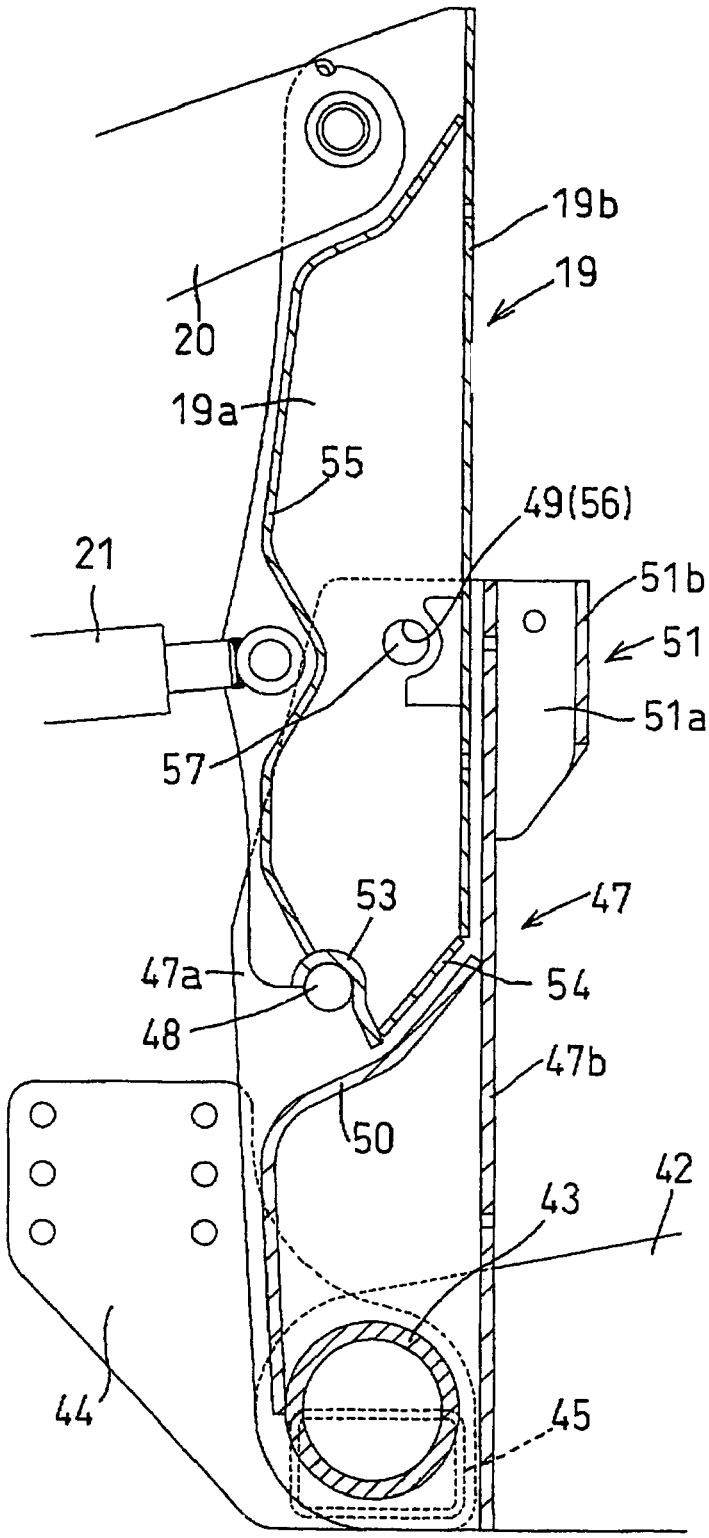
FIG. 8 is a sectional side view of a mounting portion of the front loader.
Figure 9:
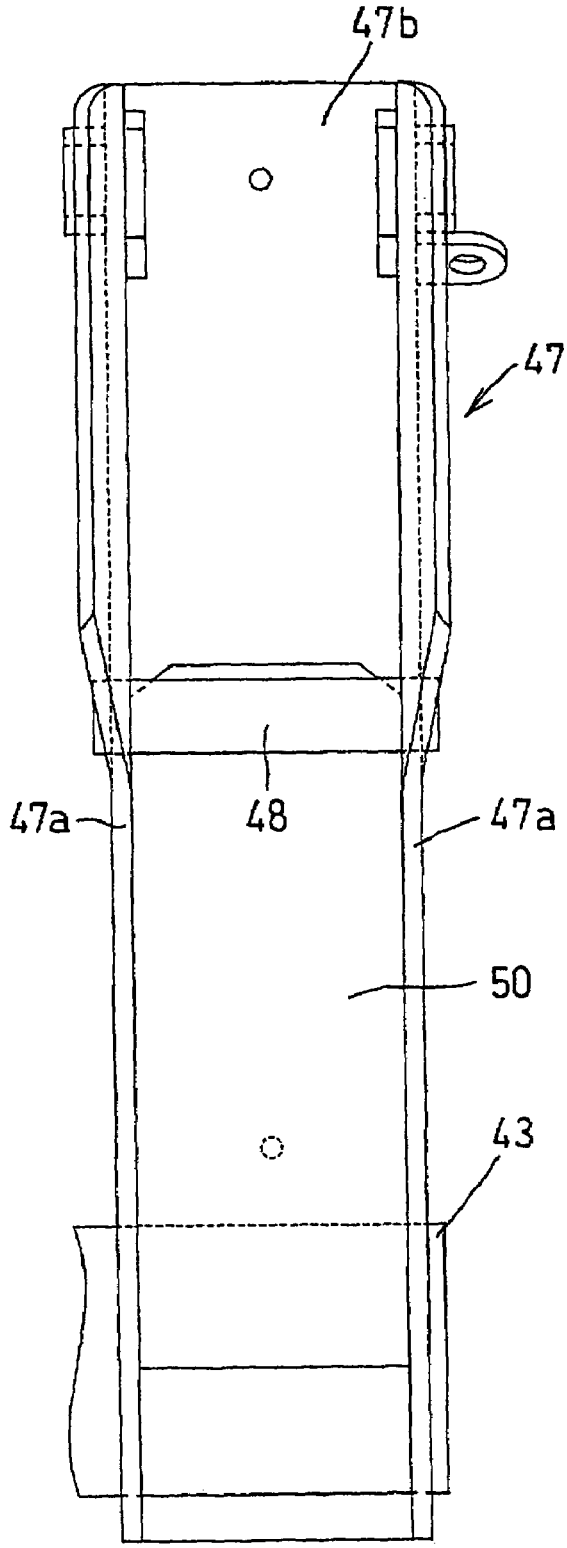
FIG. 9 is a front view of a loader mount.
Figure 10:
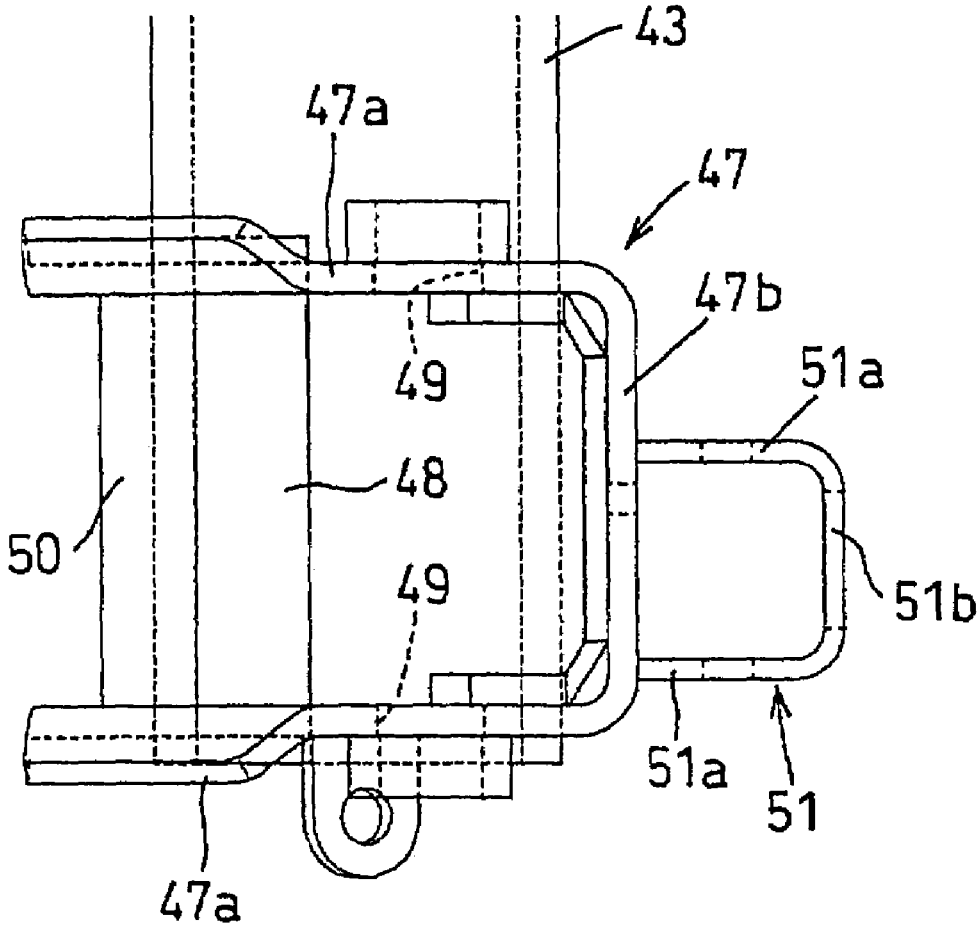
FIG. 10 is a plan view of the loader mount.
Figure 11:
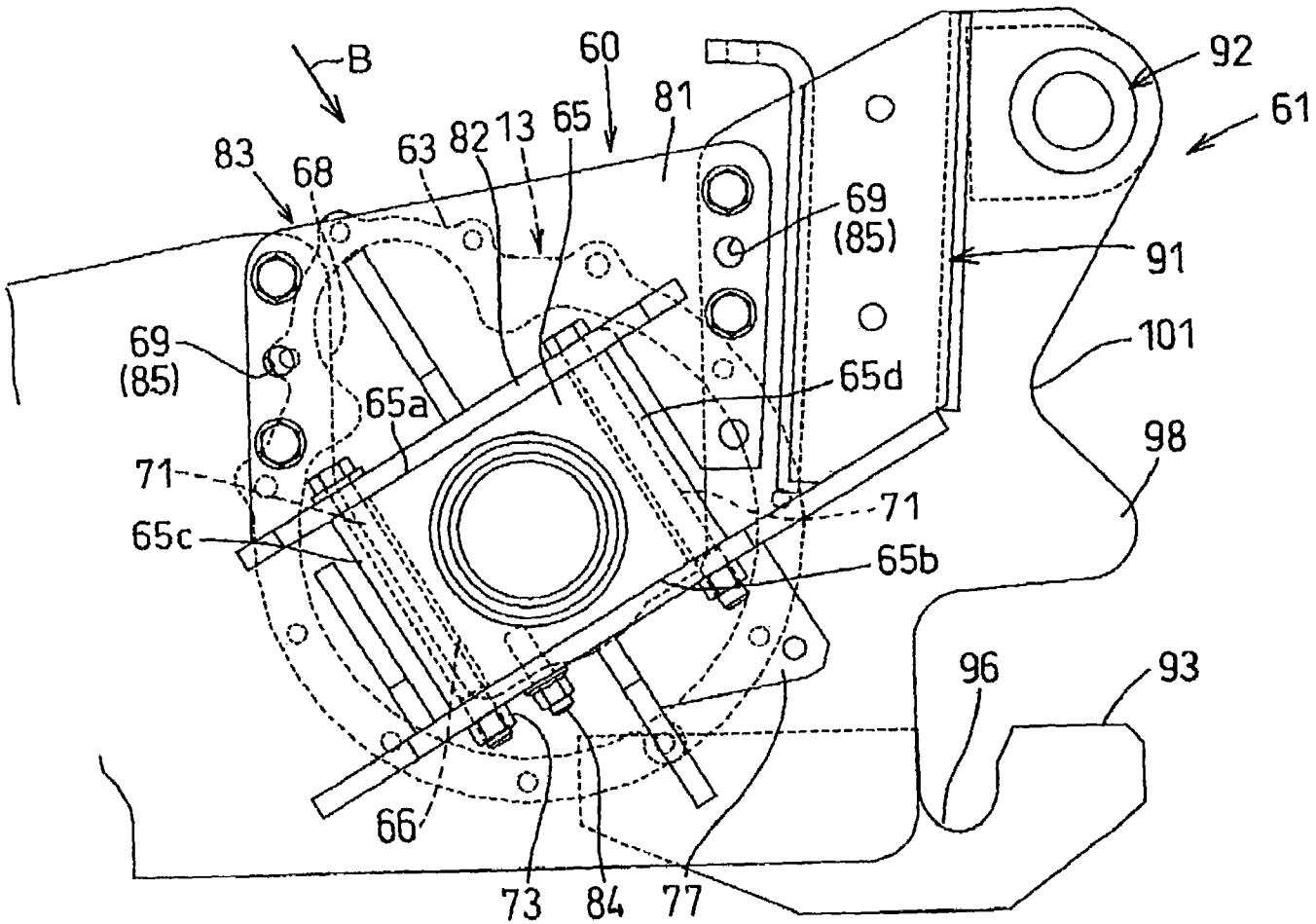
FIG. 11 is a side view of a rear portion of the mounting frame attached to rear axles.
Figure 12:
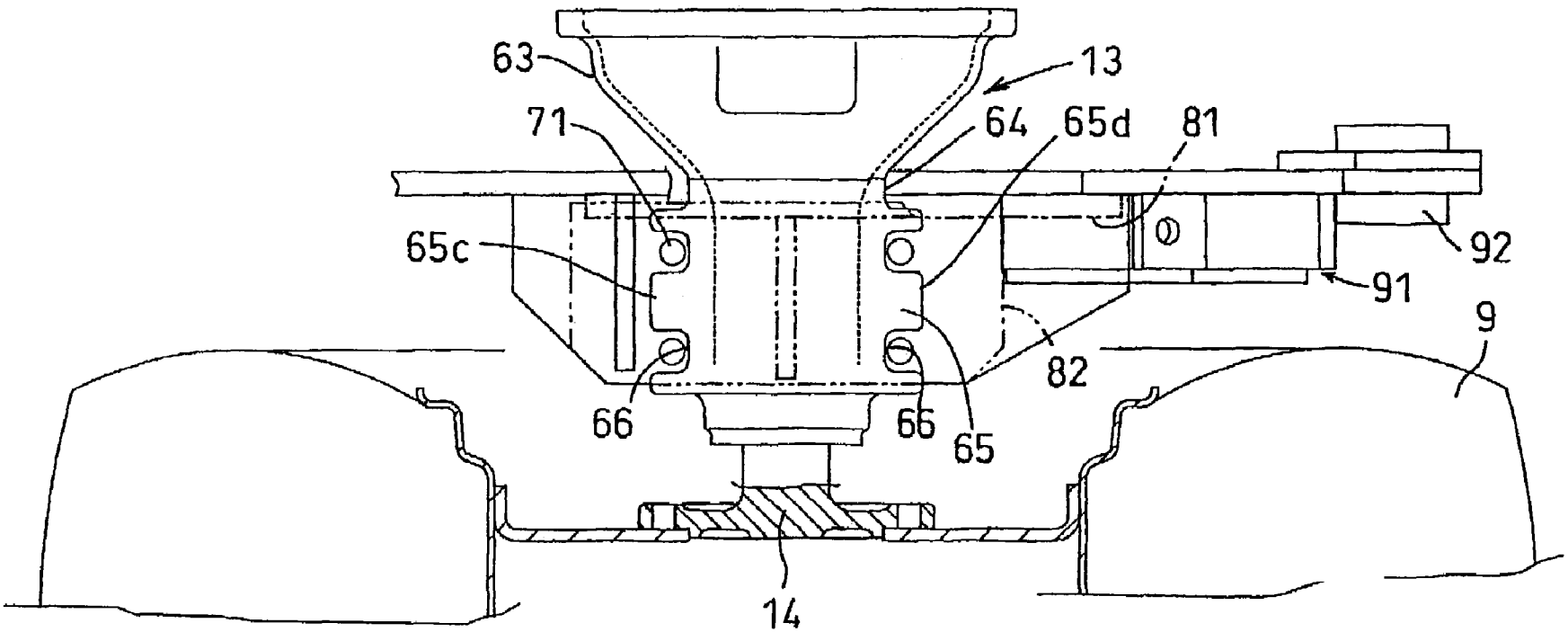
FIG. 12 is a section taken in a direction of arrow B of FIG. 11.
Figure 13:
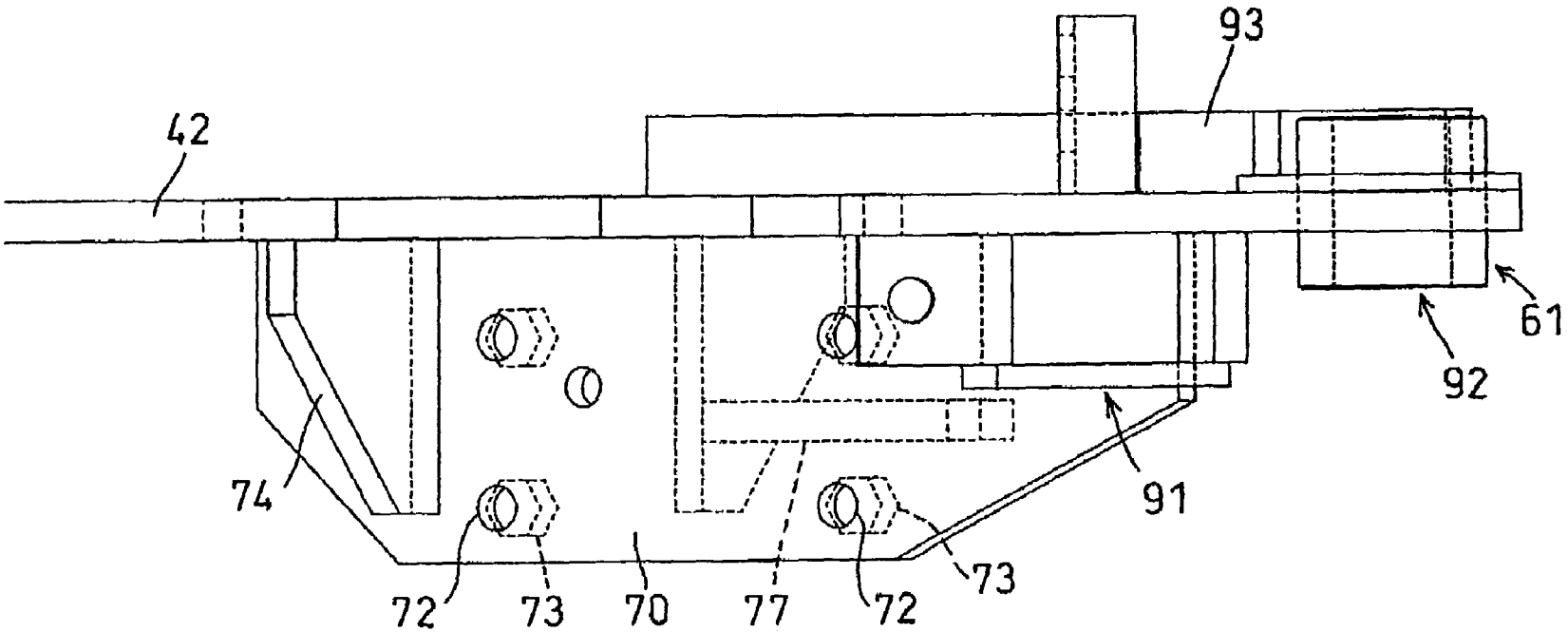
FIG. 13 is a plan view of the rear portion of the mounting frame attached to the rear axles.
Figure 14:
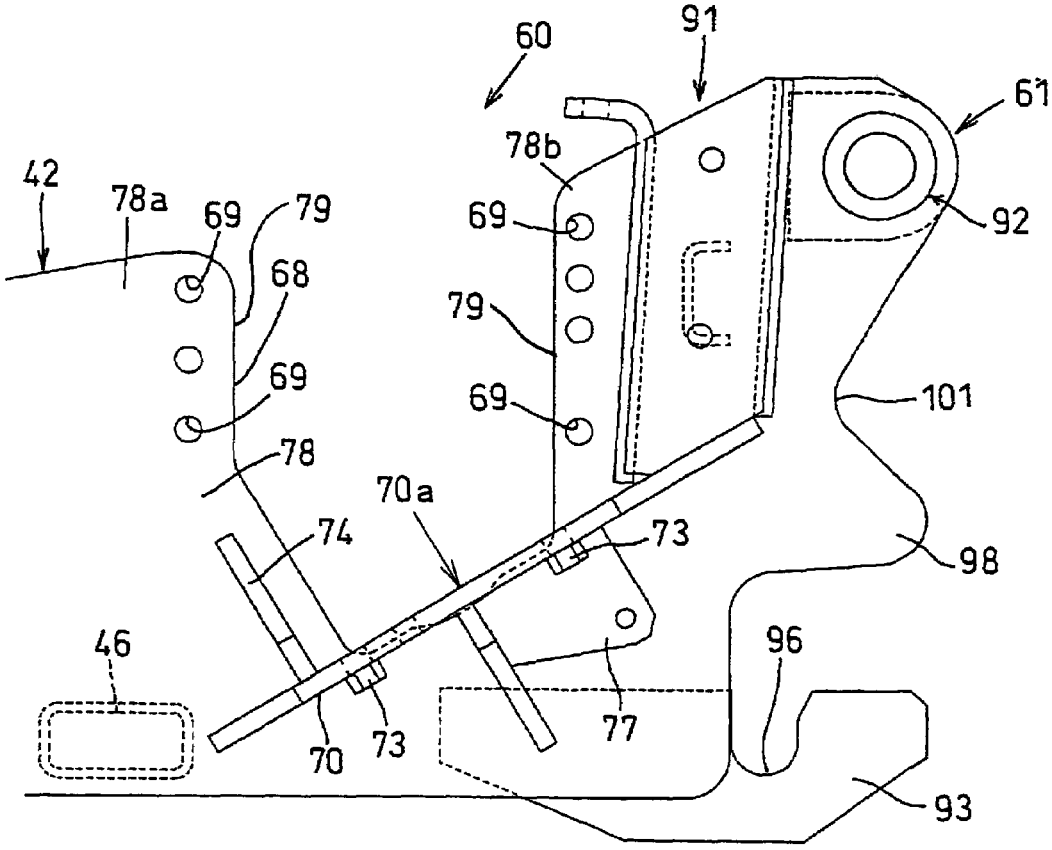
FIG. 14 is a side view of the rear portion of the mounting frame attached to the rear axles.
Figure 15A:
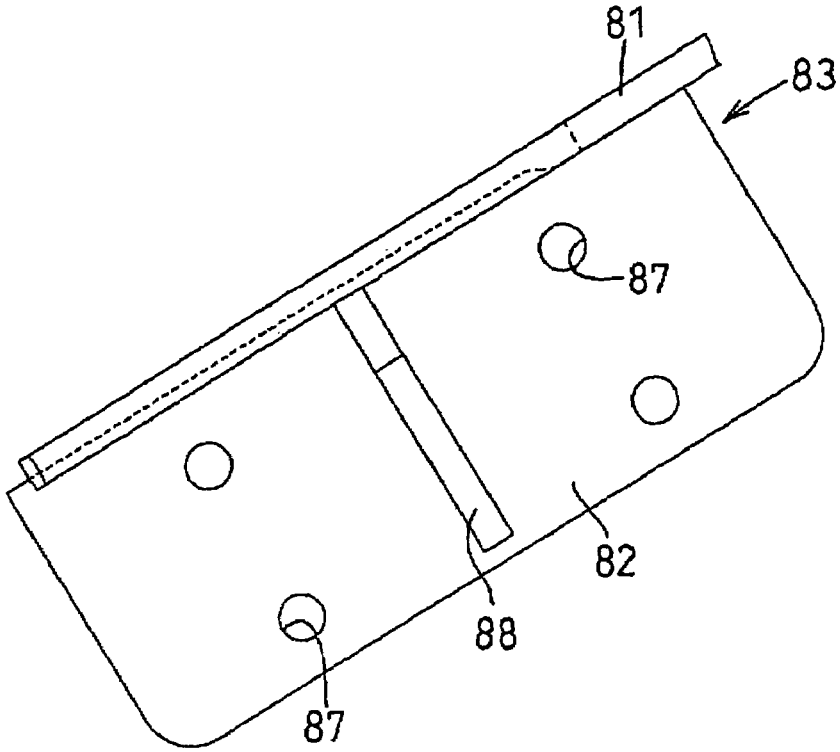
FIG. 15A is a plan view showing a bridge member and an upper mount.
Figure 15B:
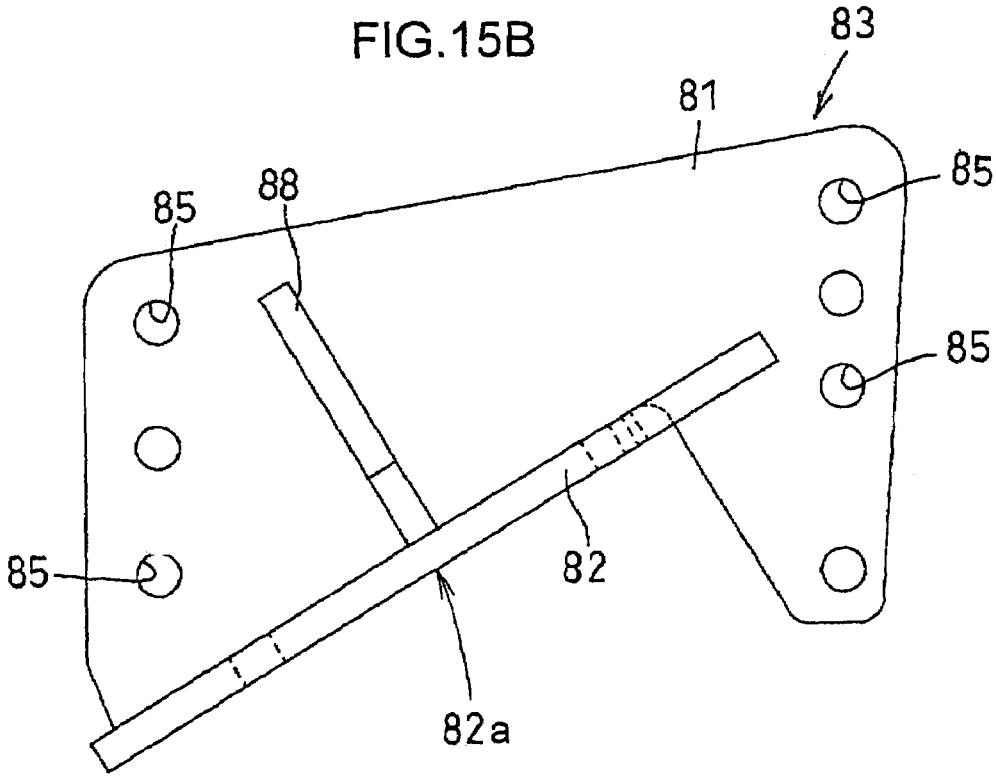
FIG. 15B is a side view showing the bridge member and the upper mount.
Figure 16:
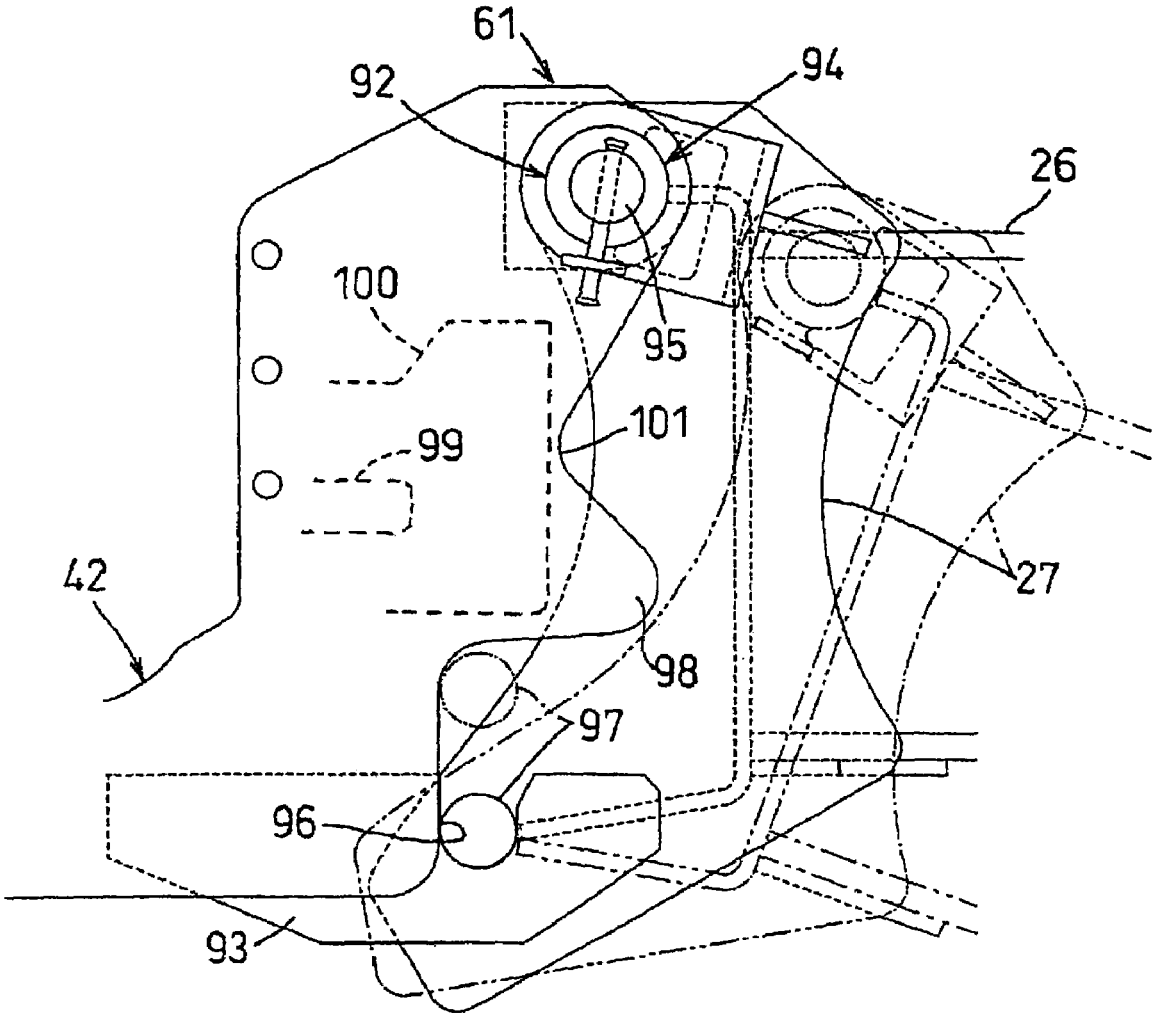
FIG. 16 is a side view of a backhoe mounting portion.

As shown in FIGS. 8 through 10, each of the right and left loader mounts 47 includes, as main components thereof, a pair of right and left side walls 47*a*, and a back wall 47*b* connecting rear portions of the right and left side walls 47*a*. Thus, each mount 47 is U-shaped opening forward as seen in plan.

The loader mounts 47 are arranged at right and left sides of the engine 6 and laterally outwardly of the front portions of the main frame 42. Lower end portions of the right and left side walls 47*a* are penetrated by laterally outward portions of the support bases 43. The right and left side walls 47*a* are fixed such as by welding to the support bases 43. Thus, the loader mounts 47 are fixed to the support bases 43 to project upward therefrom.

Each loader mount 47 has, in a vertically intermediate position thereof, a support 48 in the form of a pin or the like extending transversely between the right and left side walls 47*a*. An upper portion of each loader mount 47 includes bores 49 formed in the right and left side walls 47*a*.

Each loader mount 47 includes, in a lower portion thereof, a reinforcing plate 50 mounted between the right and left side walls 47*a*. The reinforcing plate 50 is fixed such as by welding to the support base 43 and the right and left side walls 47*a* and back wall 47*b* of and the loader mount 47.

The reinforcing plate 50 extends upward from the front surface of the support base 43, through an area below the support 48, and upward and rearward to the back wall 47*b*.

A post mount 51 is disposed on an upper back surface of the back wall 47*b* of each loader mount 47. The post mount 51 includes right and left side walls 51*a* fixed to the back of the loader mount 47, and a back wall 51*b* connecting upper rear edges of the right and left side walls 51*a*.

A lower end of a front post 52 of FOPS/ROPS 5 is inserted into this post mount 51 and fixed thereto by pins or bolts.

On the other hand, each of the right and left side frames 19 of the front loader 3 includes, as main components thereof, a pair of right and left side walls 19*a*, and a back wall 19*b* connecting rear portions of the right and left side walls 47*a*. Thus, each side frame 19 is U-shaped opening forward as seen in plan, and removably insertable into the loader mount 47 from front.

Each side frame 19 includes a supported member 53 disposed in a lower position thereof between the right and left side walls 19*a* for removably fitting on the support 48 of the loader mount 47 from above, to be rotatable about a transverse axis. This supported member 53 is connected to the back wall 19*b* by a reinforcing plate 54. Further, a reinforcing plate 55 extends from an upper position to a lower position between the right and left side walls 19*a*.

The right and left side walls 19*a* of each side frame 19 define bores 56 that register with the bores 49 in the right and left side walls 47*a* of the loader mount 47 when the supported member 53 fitted on the support 48. When the supported member 53 fitted on the support 48, a pin 57 is passed through the bores 49 in the right and left side walls 47*a* of the loader mount 47 and the bores 56 in the right and left side walls 19*a* of the side frame 19. Consequently, the side frame 19 is attached to the loader mount 47, in a way to restrict its pivotal movement about the support 48 and upward movement.

A stand 59 is attached to a forward position in the undersurface of each boom 20 for supporting the boom 20, with the bucket 22 resting on the ground, when the front loader 3 is detached from the tractor 2.

The stand 59 is attached to the boom 20 to be switchable between a use position shown in solid lines and a non-use position shown in phantom lines in FIG. 4.

The support 48 may be in the form of an upwardly opening cutout, and the supported member 53 in the form of a pin.

With the above construction for attaching the front loader 3, when detaching the front loader 3 attached as shown in FIG. 4, for example, the lower front end of the bucket 22 is placed on the ground, each stand 59 is switched from the non-use position to the use position, and the pins 57 are pulled out of the bores 49 and 56 in the loader mounts 47 and side frames 19.

At this time, the stands 59 are maintained out of contact with the ground.

Next, when the bucket cylinder 24 is contracted to cause a pivotal movement in the direction of arrow A (upward), the side frames 19 are first turned forward about supports 48 to place the stands 59 on the ground. Once the stands 59 contact the ground, the side frames 19 are turned about the ground-engaging positions of the stands 59, whereby the supported members 53 of the side frames 19 separate upward from the supports 48. In this state, the front loader 3 stands unassisted, with the booms 20 of the front loader 3 supported by the bucket 22 and stands 59.

Thereafter, the tractor 2 is moved backward.

The front loader 3 is attached to the tractor 2 in a sequence reversed from the above. The operations for attaching and detaching the front loader 3 are shown by way of example only. The front loader 3 may be attached and detached in a way other than the above method (by extending the boom cylinders 21, for example).

As shown in FIGS. 11 through 16, each of the right and left main frames 42 has, in a rear portion thereof, a rear axle case mounting unit 60 for mounting the main frame 42 on the rear axle case 13 of the tractor body 2A. A backhoe mount (working implement mount) 61 is disposed rearwardly of the rear axle case mounting unit 60 for detachably attaching the backhoe 4.

On the other hand, each rear axle case 13 includes a lid 63 at a transversely inward side thereof for closing a brake case attached to a rearward side of the gearbox 11. A support portion 65 projects laterally outward from the lid 63 through a fitting portion 64 having a cylindrical outer configuration.

The support portion 65 of the rear axle case 13 receives the rear axle case mounting unit 60 of the main frame 42 for supporting the main frame 42. This support portion 65 is formed to have an outer configuration of a square pole with an axis extending in the transverse direction. The support portion 65 has an upper surface (contact surface) 65*a* and a lower surface (contact surface) 65*b* formed in the shape of flat surfaces, and front and rear surfaces 65*c* and 65*d* defining bolt-receiving grooves 66 extending parallel along the front and rear surfaces 65*c* and 65*d* from the upper surface 65*a* to the lower surface 65*b* in a direction perpendicular to the transverse direction.

The rear axle case 13 is attached at a tilt so that the upper surface 65*a* and lower surface 65*b* extend forward and downward. Thus, the upper surface 65*a* and lower surface 65*b* are inclined relative to a horizontal plane.

The rear axle case mounting unit 60 of the main frame 42 defines an upwardly opening cutout 68 for fitting on the fitting portion 64 of the rear axle case 13 from below. Consequently, the rear axle case 13 extends through the main frame 42.

A cutout-forming region 78 of the main frame 42 has a front portion 78*a* and a rear portion 78*b* each defining a plurality of bolt-receiving bores 69 arranged vertically.

The rear axle case mounting unit 60 a lower mounting unit 70 located below the support portion 65 of the rear axle case 13.

This lower mounting unit 70 is formed of a plate and is inclined to extend forward and downward as is the lower surface 65*b* of the support portion 65 of the rear axle case 13. The lower mounting unit 70 has an upper contact surface 70*a* contacted by the lower surface 65*b* of the support portion 65 of the rear axle case 13 and fixed such as by welding to the outer side surface of the main frame 42.

The lower mounting unit 70 defines bolt-receiving bores 72 for receiving bolts 71 extending through the bolt-receiving grooves 66 of the support portion 65 of the rear axle case 13. Nuts 73 are fixed to the lower surface of the lower mounting unit 70 (or may not be fixed) for meshing with the bolts 71 extending through the bolt-receiving grooves 66 of the support portion 65 of the rear axle case 13.

Moreover, the lower mounting unit 70 defines bores for receiving stud bolts 84 screwed into the lower surface of the support portion of the rear axle case 13.

The lower mounting unit 70 has a reinforcing plate 74 fixed to a forward position thereof and to the outer side surface of the main frame 42.

Further, the lower mounting unit 70 has a restrictor mount 77 formed on the lower surface thereof for attaching a restricting member 76 that restricts movement of the lower link 18 of the three-point link mechanism attached to the rear of the body 2A of the tractor 2 (FIG. 2).

The rear axle case mounting unit 60 further includes a bridge member 81 connecting (cutout opening sides 79 of) the front portion 78*a* and rear portion 78*b* of the cutout-forming region 78 of the main frame 42, and an upper mounting unit 82 located above the support portion 65 of the rear axle case 13 for pinching the rear axle case 13 with the lower mounting unit 70 to mount the main frame 42 on the rear axle case 13. The bridge member 81 and upper mounting unit 82 are formed integral with each other as a member 83.

The bridge member 81 and upper mounting unit 82 are formed of plates and integrated with each other by being fixed such as by welding (or may be formed by bending one plate).

The bridge member 81 defines, in a front portion and a rear portion thereof, bolt-receiving bores 85 corresponding to the bolt-receiving bores 69 formed in the cutout-forming region 78 of the main frame 42. The bridge member 81 is attached to the main frame 42 by bolts inserted through these bolt-receiving bores 69 and 85 and nuts meshed with these bolts.

The upper mounting unit 82 is inclined to extend forward and downward as is the upper surface 65*a* of the support portion 65 of the rear axle case 13. The upper mounting unit 82 has a lower contact surface 82*a* contacted by the upper surface 65*a* of the support portion 65 of the rear axle case 13

The upper mounting unit 82 defines bolt-receiving bores 87 for receiving the bolts 71 extending through the bolt-receiving grooves 66 of the support portion 65 of the rear axle case 13.

The member 83 has a reinforcing plate 88 fixed such as by welding to the bridge member 81 and the upper mounting unit 82.

With the above structure for mounting each main frame 42, the cutout 68 is fitted on the fitting portion 64 of the rear axle case 13 from below to place the lower surface 65*b* of the support portion 65 of the rear axle case 13 on the lower mounting unit 70. Then, the upper mounting unit 82 is placed to contact the upper surface 65*a* of the support portion 65 of the rear axle case 13. The bolts 71 with heads are passed through the bolt-receiving bores 87 of the upper mounting unit 82, the bolt-receiving grooves 66 of the support portion, and the bolt-receiving bores 72 of the upper mounting unit 70, and screwed into the nuts 73. As a result, the main frame 42 is mounted on the rear axle case 13, with the support portion 65 of the rear axle case 13 pinched by the lower mounting unit 70 and upper mounting unit 82.

In the above structure for mounting each main frame 42, the contact surfaces (upper and lower surfaces) 65*a* and 65*b* of the support portion 65 of the rear axle case 13 for contacting the lower mounting unit 70 and upper mounting unit 82 are formed in the shape of flat surfaces, and the rear axle case 13 is attached so that the contact surfaces 65*a* and 65*b* are inclined relative to a horizontal plane. Consequently, a load applied longitudinally from the front loader 3 or backhoe 4 to the main frames 42 is dispersed vertically in the position where the main frame 42 is mounted on the rear axle case 13. A load acting vertically is dispersed longitudinally. Thus, a stress acting where the main frame 42 is mounted on the rear axle case 13 is dispersed.

In the above construction, the rear axle case 13 may have the upper surface 65*a* and lower surface 65*b* of the support portion 65 extending longitudinally of the tractor.

Each main frame 42 includes a post mount 91 disposed rearwardly of the rear axle case mounting unit 60 for inserting and attaching the lower end of a rear post 90 of FOPS/ROPS 5.

The backhoe mount 61 includes a coupling 92 disposed in an upper rear end position of the main frame 42, and a receiving member 93 projecting rearward from a lower rear end position of the main frame 42.

The coupling 92 is coupled to a coupling 94 disposed in an upper position of one of the mounts 27 of the backhoe 4. The couplings 92 and 94 are connected by a coupling pin 95 extending transversely therethrough.

The receiving member 93 is fixed such as by welding to the inner side surface of the main frame 42. The receiving member 93 defines an upwardly opening cutout 96. The cutout 96 receives a connecting bar 97 disposed in a lower position of the mount 27 of the backhoe 4.

The connecting bar 97 extends transversely between the right and left mounts 27 of the backhoe 4. Opposite ends of the connecting bar 97 project laterally outward from the mounts 27, and the portions of the connecting bar 97 projecting laterally outward from the mounts 27 are fitted in the cutouts 96 of the receiving members 93.

With the structure for mounting the backhoe 4, when detaching the backhoe 4 from the mounting frame 41, each coupling pin 95 is removed from the couplings 92 and 94 with the legs 38 of the outriggers 33 and the bucket 32 are placed in contact with the ground. In this state, as shown in phantom lines in FIG. 16, for example, the mounts 27 are swung backward about the axis of the connecting bar 97 by controlling the arm 31, bucket 32 or boom 30. Thereafter the outriggers 33 are controlled to raise the mounts 27 to move the connecting bar 97 upward out of the cutouts 96. In this state, the tractor 2 is moved forward.

A vertically intermediate portion at the rear end of each main frame 42 projects rearward to define a restrictor 98 for restricting upward movement of the connecting bar 97 of the backhoe 4 fitted in the cutout 96.

The connecting bar 97 fitted in the cutout 96 of the receiving member 93 is located below a PTO cover 100 covering a PTO shaft 99. The restrictor 98 prevents the connecting bar 97 from contacting the PTO cover 100.

Each main frame 42 defines a restrictor recess 101 indented forward in a vertically intermediate position at the rear end thereof above the restrictor 98 and below the coupling 92.

The restrictor recess 101 is provided to allow the restricting member 76 that restricts movement of the lower link 18 of the three-point link mechanism attached to the rear of the body 2A of the tractor 2, to avoid interference (contact) with the main frame when the lower link 18 is raised.

What is claimed is:

1. A mounting frame unit attached to a tractor body for enabling working implements including a front loader and a backhoe to be attached to the tractor body, comprising:

a pair of right and left main frames extending longitudinally of said tractor body;

connecting frames for connecting said main frames as spaced from each other;

a lower mounting unit disposed in a rearward section of each of said main frames and connected to a rear axle case forming part of said tractor body;

a bridge member for bridging upper positions of an upwardly opening cutout formed in said rearward section; and an upper mounting unit disposed on said bridge member and connected to said rear axle case;

wherein said upper mounting unit defines an inclined contact surface for contacting an upper inclined contact surface formed on said rear axle case, and said lower mounting unit defines an inclined contact surface for contacting a lower inclined contact surface formed on said rear axle case.

2. A mounting frame unit as defined in claim 1, wherein each of said main frames is formed of a plate, and disposed to have a plate width extending vertically, each of said main frames having a vertical width progressively enlarging from front to rear.

3. A mounting frame unit as defined in claim 1, further comprising a loader mounting unit disposed in a forward position thereof for detachably attaching side frames of a braceless type front loader, and a backhoe mounting unit disposed in a rearward position for detachably attaching the backhoe, said loader mounting unit supporting front posts of a four-post ROPS.

4. A mounting frame unit attached to a tractor body for enabling working implements including a front loader and a backhoe to be attached to the tractor body, comprising:

a pair of right and left main frames extending longitudinally of said tractor body;

connecting frames for connecting said main frames as spaced from each other;

a loader mounting unit disposed in a forward position of said mounting frame unit for detachably attaching side frames of a braceless type front loader; and a backhoe mounting unit disposed in a rearward position of said mounting frame unit for detachably attaching the backhoe;

wherein each of said main frames is formed of a plate, and disposed to have a plate width extending vertically, each of said main frames having a vertical width progressively enlarging from front to rear.

5. A mounting frame unit as defined in claim 4, wherein said loader mounting unit supports front posts of a four-post ROPS.

6. A mounting frame unit attached to a tractor body for enabling working implements including a front loader and a backhoe to be attached to the tractor body, comprising:

a pair of right and left main frames extending longitudinally of said tractor body;

connecting frames for connecting said main frames as spaced from each other;

a lower mounting unit disposed in a rearward section of each of said main frames and connected to a rear axle case forming part of said tractor body;

a bridge member for bridging upper positions of an upwardly opening cutout formed in said rearward section; and an upper mounting unit disposed on said bridge member and connected to said rear axle case;

wherein each of said main frames is formed of a plate, and disposed to have a plate width extending vertically, each of said main frames having a vertical width progressively enlarging from front to rear.

7. A mounting frame unit as defined in claim 6, further comprising a loader mounting unit disposed in a forward position thereof for detachably attaching side frames of a braceless type front loader, and a backhoe mounting unit disposed in a rearward position for detachably attaching the backhoe, said loader mounting unit supporting front posts of a four-post ROPS.

8. A mounting frame unit attached to a tractor body for enabling working implements including a front loader and a backhoe to be attached to the tractor body, comprising:

a pair of right and left main frames extending longitudinally of said tractor body;

connecting frames for connecting said main frames as spaced from each other;

a lower mounting unit disposed in a rearward section of each of said main frames and connected to a rear axle case forming part of said tractor body;

a bridge member for bridging forward-upper and rear-upper positions of an upwardly opening cutout formed in said rearward section, said bridge member defining first and second frame connecting portions at forward and rearward positions thereof, respectively; and an upper mounting unit formed integral with said bridge member and connected to said rear axle case, wherein each said upper mounting unit is connected to each said main frames by means of said first and second frame connecting portions.

9. A mounting frame unit as defined in claim 8, wherein said upper mounting unit defines an inclined contact surface for contacting an upper inclined contact surface formed on said rear axle case, and said lower mounting unit defines an inclined contact surface for contacting a lower inclined contact surface formed on said rear axle case.

10. A mounting frame unit as defined in claim 8, wherein each of said main frames is formed of a plate, and disposed to have a plate width extending vertically, each of said main frames having a vertical width progressively enlarging from front to rear.

11. A mounting frame unit as defined in claim 8, further comprising a loader mounting unit disposed in a forward position thereof for detachably attaching side frames of a braceless type front loader, and a backhoe mounting unit disposed in a rearward position for detachably attaching the backhoe, said loader mounting unit supporting front posts of a four-post ROPS.

* * * * *